US007073920B2

(12) United States Patent
Konkle, Jr. et al.

(10) Patent No.: US 7,073,920 B2
(45) Date of Patent: Jul. 11, 2006

(54) LAMP

(75) Inventors: Stephen A. Konkle, Jr., Kirkland, WA (US); Robert W. Anderson, Kirkland, WA (US); Carol M. Anderson, Kirkland, WA (US); Sandra J. Konkle, Kirkland, WA (US)

(73) Assignee: CS3, LLC, Bellevue, WA (US)

( * ) Notice: Subject to any disclaimer, the term of this patent is extended or adjusted under 35 U.S.C. 154(b) by 0 days.

(21) Appl. No.: 10/756,202

(22) Filed: Jan. 12, 2004

(65) Prior Publication Data

US 2005/0152136 A1 Jul. 14, 2005

(51) Int. Cl.
*F21V 35/00* (2006.01)

(52) U.S. Cl. ..... 362/161; 362/190

(58) Field of Classification Search ..... 362/161, 362/190; 431/298, 291, 302
See application file for complete search history.

(56) References Cited

U.S. PATENT DOCUMENTS

| | | | | | |
|---|---|---|---|---|---|
| 925,563 | A | * | 6/1909 | Coulter | 362/159 |
| 3,697,739 | A | * | 10/1972 | Novak et al. | 362/161 |
| 4,693,681 | A | * | 9/1987 | Comstock | 431/324 |
| 4,917,598 | A | * | 4/1990 | Stoner | 431/320 |
| 5,127,825 | A | * | 7/1992 | Tendick, Sr. | 431/320 |

OTHER PUBLICATIONS

U.S. Appl. No. 29/197,093, filed Jan. 8, 2004, Konkle, Jr. et al.
U.S. Appl. No. 29/197,094, filed Jan. 8, 2004, Konkle, Jr. et al.

* cited by examiner

*Primary Examiner*—Ali Alavi
(74) *Attorney, Agent, or Firm*—Seed IP Law Group PLLC

(57) ABSTRACT

A lamp includes a body having a receptacle to receive a liquid or gel fuel, and a cover. The lamp closely resembles a candle.

29 Claims, 9 Drawing Sheets

LAMP

BACKGROUND OF THE INVENTION

1. Field of the Invention

This disclosure generally relates to illumination devices such as lamps that employ a flame and a consumable fuel such as a paraffin based liquid or gel.

2. Description of the Related Art

Candles are becoming an increasingly popular item for adding ambiance to homes and other environments. Candles typically include a consumable wax based fuel that is essentially solid at standard room temperatures. Candles suffer from a number of drawbacks which may hinder commercial sales. Many candles including so-called "dripless" candles, drip molten wax during use, creating a safety hazard and leaving undesirable wax deposits on the sides of the candle, candleholders, tabletops and other surfaces. With standard, non-tapered candles, the end of the wick and hence the flame rapidly recedes below the upper rim of the candle, reducing the amount of effective light emitted by the candle and diminishing the candle's aesthetic appeal. This may be a particular problem for candles over approximately three inches in height or with relatively large diameters, which are otherwise preferred by many consumers. This effect is so pronounced that consumers are known to dispose of candles long before the major portion of the candle has been exhausted.

Oil based lamps are also increasingly popular for providing ambience to homes, patios and other environments. Oil based lamps typically burn a consumable paraffin based liquid or gel. Oil based lighting has the advantage of being refillable, and hence reusable, but oftentimes does not have the same aesthetic appeal of a candle. It would be desirable to have an illumination device with the aesthetic appeal of a candle, that is refillable, and which overcomes some of the deficiencies discussed above.

BRIEF SUMMARY OF THE INVENTION

In one aspect, a lamp comprises a body having an upper end and a lower end opposed to the upper end, the body comprising a wall having an outer perimeter and an inner perimeter, the inner perimeter of the wall forming at least a portion of a receptacle, the receptacle open about at least one of the upper and the lower ends of the body; a cover removably positionable with respect to the open one of the upper and the lower ends of the body to substantially close the receptacle when in use; and a non-flammable inner member positioned in one of the cover and the body, the inner member forming an aperture therethrough for providing access to an exterior of the receptacle, the aperture sized to receive a portion of a wick therethrough, wherein the one of the body and the cover in which the inner member is positioned has a concave face concentric about the inner member and is translucent at least proximate the concave face, and wherein the aperture is spaced below an outer edge of the concave space.

In another aspect, a lamp comprises: a body having an upper end and a lower end opposed to the upper end, the body comprising a wall having an outer perimeter and an inner perimeter, the inner perimeter of the wall forming at least a portion of a receptacle, the receptacle having an opening proximate at least the upper end of the body; and a cover removably positionable with respect to the upper end of the body to substantially close the opening of the receptacle, the cover comprising an outer member and an inner member, the outer member having a concave face with an outer edge, at least a portion of the outer member proximate the concave face being translucent, and, the inner member having an aperture formed therethrough for providing access to an exterior of the receptacle, the aperture sized to receive a portion of a wick therethrough, wherein an exit for the wick formed by the aperture is spaced relatively beneath the outer edge of the concave face.

In still a further aspect, a lamp comprises: a body having an upper end and a lower end opposed to the upper end, the body comprising a wall, having an outer perimeter and an inner perimeter, the inner perimeter of the wall forming at least a portion of a receptacle, the receptacle open proximate at least one of the upper and the lower ends of the body; a cover having a concave face, the cover removably positionable with respect to the upper end to substantially close the receptacle, the cover comprising an outer portion and an inner portion of the similar materials, the inner portion having an aperture formed therethrough for providing access to an exterior of the receptacle, the aperture sized to receive a portion of a wick therethrough, wherein the outer portion of the cover is translucent and wherein an outer edge of the concave face is approximately coextensive with an outer perimeter of the cover, and the outer perimeter of the cover is closely received by the inner perimeter of the wall forming the receptacle; an opaque screen having an outer perimeter sized for being closely received in the receptacle beneath the cover, the opaque screen having a hole sized to at least receive a portion of the wick therethrough, the opaque screen having a reflective surface facing the cover.

BRIEF DESCRIPTION OF THE SEVERAL VIEWS OF THE DRAWING(S)

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with lamps have not been shown or described in detail to avoid unnecessarily obscuring descriptions of the embodiments of the invention.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Further more, the particular features, structures, or characteristics may be combined in any suitable manner in one or more embodiments.

The headings provided herein are for convenience only and do not interpret the scope or meaning of the claimed invention.

Figure 1:
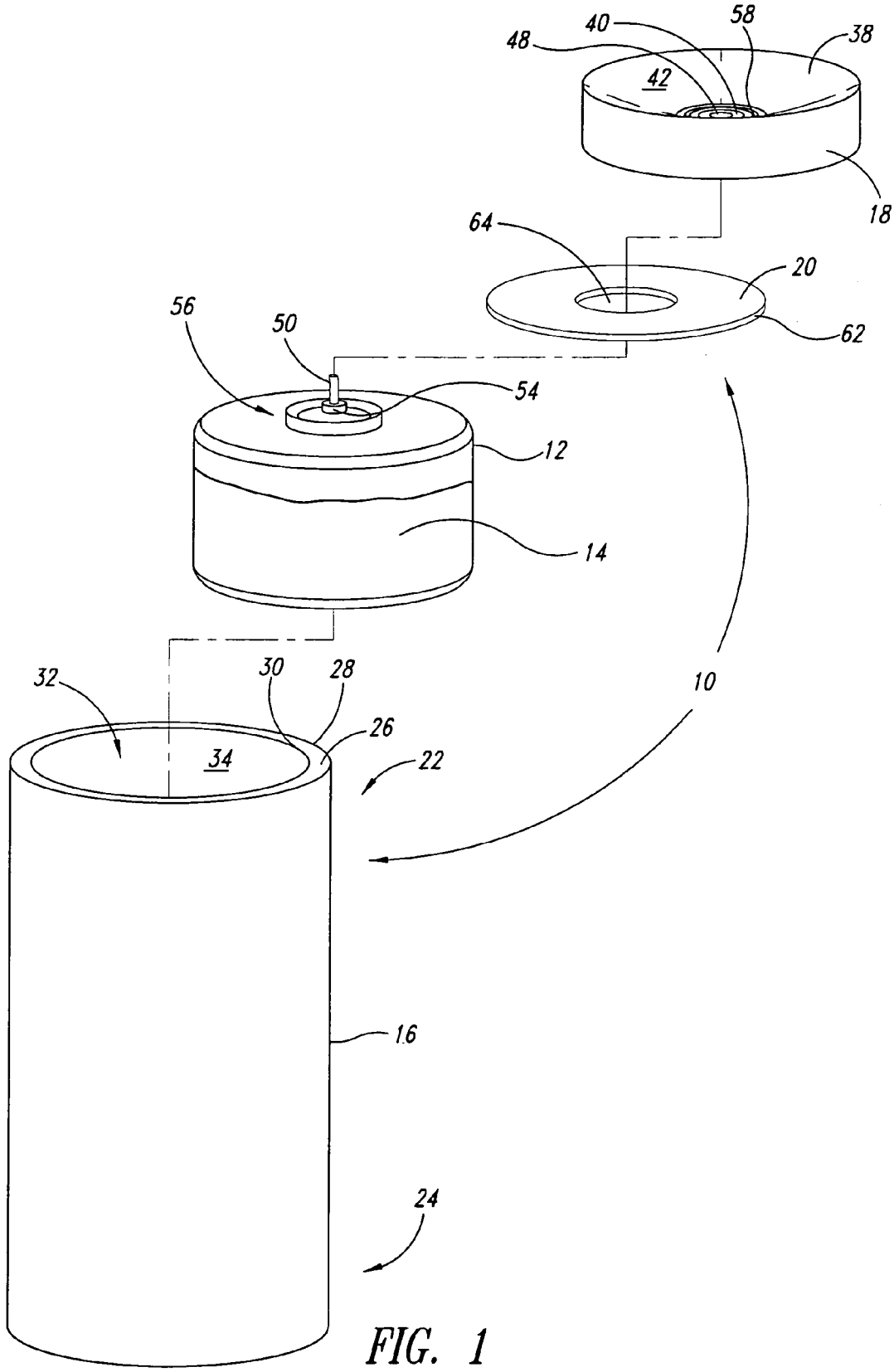
FIG. 1 is an exploded isometric view of a lamp, and a canister of fuel according to one illustrated embodiment, the lamp comprising a body forming a receptacle for receiving the canister, a cover and an opaque screen.
Figure 2:
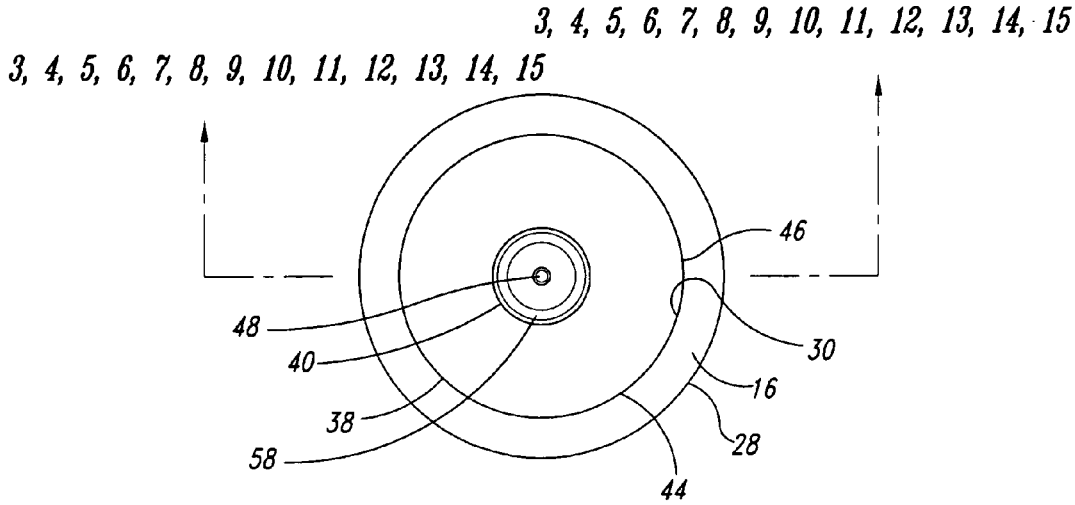
FIG. 2 is a top plan view of the lamp of FIG. 1.
Figure 3:
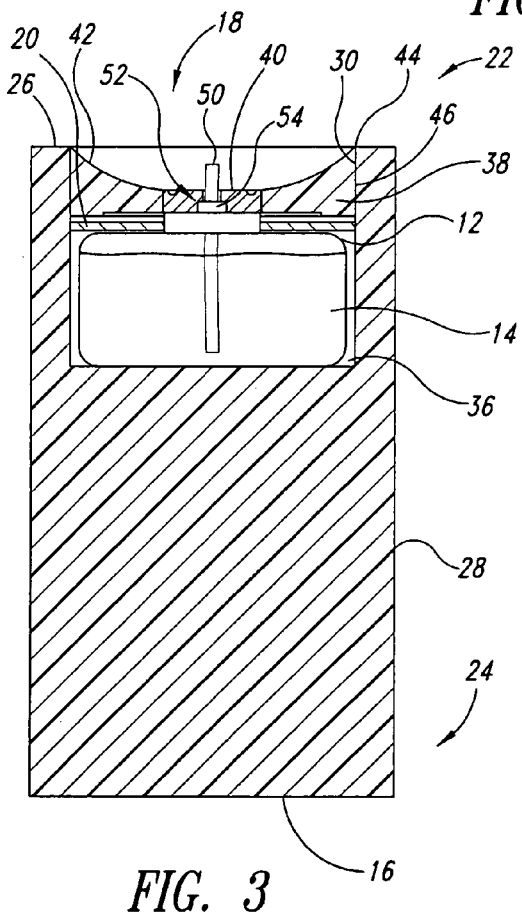
FIG. 3 is a cross-sectional view of the lamp of FIGS. 1 and 2.

FIGS. 1–3 show a lamp 10 and a canister 12 containing a consumable oil based liquid or gel fuel 14 for use with the lamp 10, according to one illustrated embodiment.

The lamp 10 includes a body 16, a cover 18, and an opaque screen 20. The body 16 has an upper end 22 and a lower end 24 opposed to the upper end 22. The body 16 comprises a wall 26 having an outer perimeter 28 and an inner perimeter 30, the inner perimeter 30 forming a receptacle 32 having at least one opening 34. While illustrated as being cylindrical, the body 16 may be any desired shape and/or size.

In the embodiment illustrated in FIGS. 1–3, the receptacle 32 has a single opening 34, proximate the upper end 22 of the body 16. The receptacle 32 and opening 34 are sized and dimension for receiving the canister 12 of fuel 14 therein. As illustrated in FIG. 3, the lower end 34 of the body 16 may be closed providing a surface 36 in the receptacle 32 for supporting the canister 12 of fuel 14 at a determined spacing with respect to the opening 34 when the canister 12 is received in the receptacle 32.

In the embodiment of FIGS. 1–3, the cover 18 is removably positionable to substantially close the opening 34 at the upper end 22 of the body 16, thereby closing the receptacle 32. The cover 18 may comprise an outer member 38 and an inner member 40.

The outer member 38 includes a concave face 42 having an outer edge 44. The concave face 42 may have a non-linear profile or slope. For example, the profile or slope of the concave face 42 may be concave (as best seen in FIG. 3), or convex (not illustrated). A perimeter 46 of the outer member 38 may be slightly smaller than the inner perimeter 30 of the body 16, so that perimeter 46 of the outer member 38 is immediately adjacent the inner perimeter 30 when the cover 18 is received in the opening 34 of the receptacle 32 so that the body 16 and cover 18 appear to be a single solid object. This appearance as a single solid object may be further enhanced by making the perimeter 46 of the outer member 38 approximately coextensive with outer edge 44 of the concave face 42.

The outer member 38 may, or may not, be formed of a non-flammable material. The outer member 38 should be translucent, particular around the perimeter 46 proximate the concave face 42, to provide a visual effect similar to that of a candle. Some suitable materials for the outer member may, for example, include a thermal setting resin, glass filed nylon resin, or acetal resin such as Delrin® which is commercially available from E.I. du Pont de Nemours and Company of Wilmington Del. These materials will exhibit a limited amount of expansion when exposed to heat from a flame. The outer member 38 may be formed by various conventional molding techniques, for example, via injection modeling, with the inner member 40 secured within the outer member 38 or selectively removable therefrom.

The inner member 40 forms an aperture 48 to provide access to an exterior of the receptacle 32, the aperture 48 sized at least to receive at a portion of a wick 50 therethrough. The inner member 40 may include a recess 52 in a bottom surface thereof, the recess 52 sized and dimensioned for mating with a complimentary structure 54 of a lid 56 of the canister 14. The inner member 40 may include a channel 58 proximate the aperture 48 to carry a scented oil which. The channel 58 may, for example, be concentric with the aperture 48. While illustrated as having a circular perimeter 46, the cover 18 can be any desired shape.

The inner member 40 is formed from a non-flammable material, and may be formed of a metal, particularly a high density metal such as a high density steel. An upper surface of the inner member 40 may further be coated with a thin layer of a material (e.g., powder coat) identical or similar to that of the outer member 38 to visually blend the inner member 40 with the outer member 38. Alternatively, the inner member 40 may be painted or otherwise colored to closely resemble the appearance of the outer member 38, although such may not be necessary in all embodiments.

A design may be printed on potions of the body 16 and the cover 18. Preferably the design is continuous across the adjacent portions of the body 16 and cover 18, without any visually perceptible breaks. One method of printing a design is via a dye sublimation process, which includes vaporizing the dyes via heating to deposit the dyes onto the target substrate (e.g., body 16 and cover 18). Such a process is commercially available from KolorFusion International of Centennial Colorado.

The opaque screen 20 has an outer perimeter 62 and forms a hole 64, the hole 64 being sized to receive a portion of the lid 56 of the canister 12 therethrough including the wick 50. The opaque screen 20 is received between a bottom of the cover 18 and the top of the canister 12, to prevent light emitted by a flame burning on the outer portion of the wick 50 from passing through the canister 12 and potentially illuminating lower portions of the body 16. This is particular useful where the body 16 is molded from a single piece of translucent material, since it simulates the appearance of a real candle, which is only translucent proximate the top portion (i.e., proximate and immediately below the concave face 42). While not specifically illustrated, the opaque screen 20 may be formed on the cover 18, for example, by printing or otherwise depositing an opaque material on a bottom thereof or by molding the opaque screen 20 therein.

Figure 4:
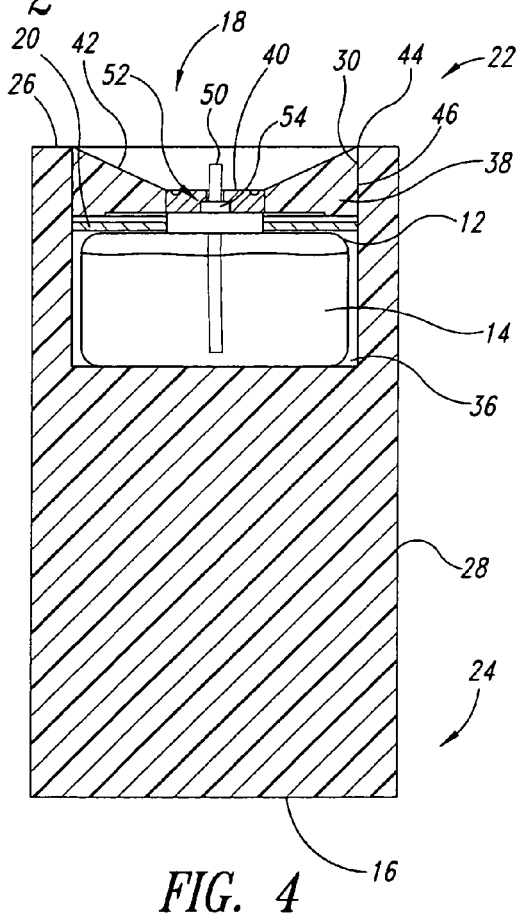
FIG. 4 is a cross-sectional view of a lamp according to another illustrated embodiment, where a concave face of an outer member of the cover has a linear profile or slope.

FIG. 4 shows another embodiment of the lamp 10. This embodiment, and those alternative embodiments and other alternatives described herein, are substantially similar to previously described embodiments, and common acts and structures are identified by the same reference numbers. Only significant differences in operation and structure are described below.

In the embodiment of FIG. 4, the concave face 42 of the outer member 38 of the cover 18 of the lamp 10 has a linear or straight profile or slope, which is particularly easy to manufacture, although the profile may not resemble a real candle as closely as the concave profile (best illustrated in FIG. 3).

Figure 5:
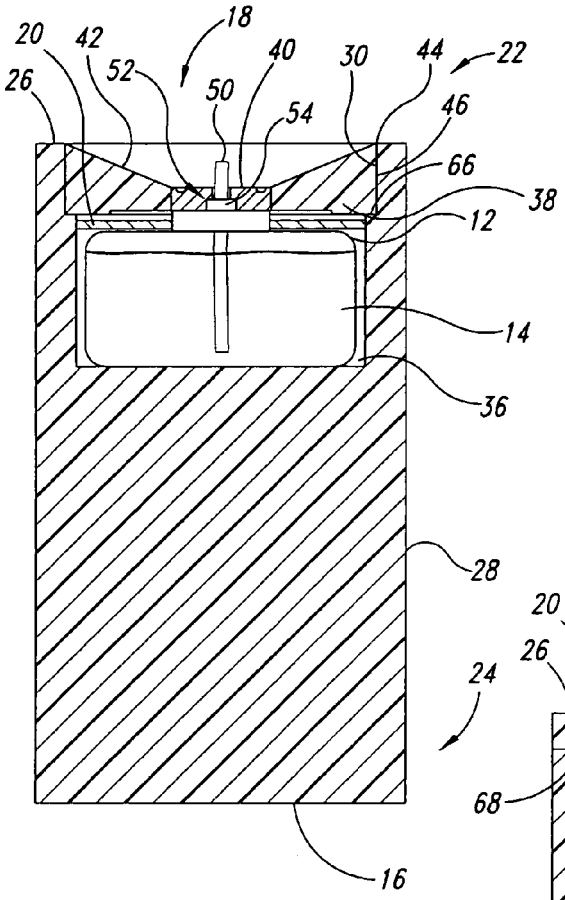
FIG. 5 is a cross-sectional view of a lamp according to another embodiment, the recess including a lip for supporting the cover.

FIG. 5 shows another embodiment of the lamp 10. In particular, in the embodiment of FIG. 5, a step or lip 66 is formed in the receptacle 32 of the body 16 for supporting the cover 18 by the outer member 38 thereof. The perimeter 46 of the outer member 38 of the cover 18 is sized and shaped to be closely received by the opening 34 proximate the step 66.

Figure 6:
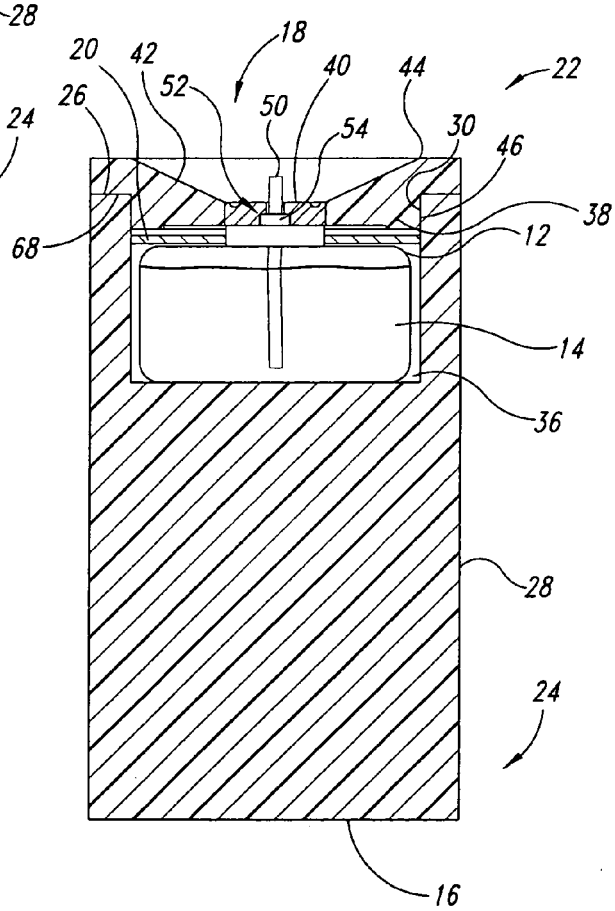
FIG. 6 is a cross-sectional view of a lamp according to still another embodiment, wherein the cover includes a flange about a perimeter thereof.

FIG. 6 shows yet another embodiment of the lamp 10. In particular, in the embodiment of FIG. 6, a flange 68 is formed about the perimeter 46 of the outer member 38 of the cover 18 for supporting the cover 18 from the upper end 22 of the body 16. This embodiment moves the seam between the cover 18 and body 16 from the top to the side of the lamp 10. This may be more conspicuous, but has the advantage of not placing any force or weight on the canister 12.

Figure 7:
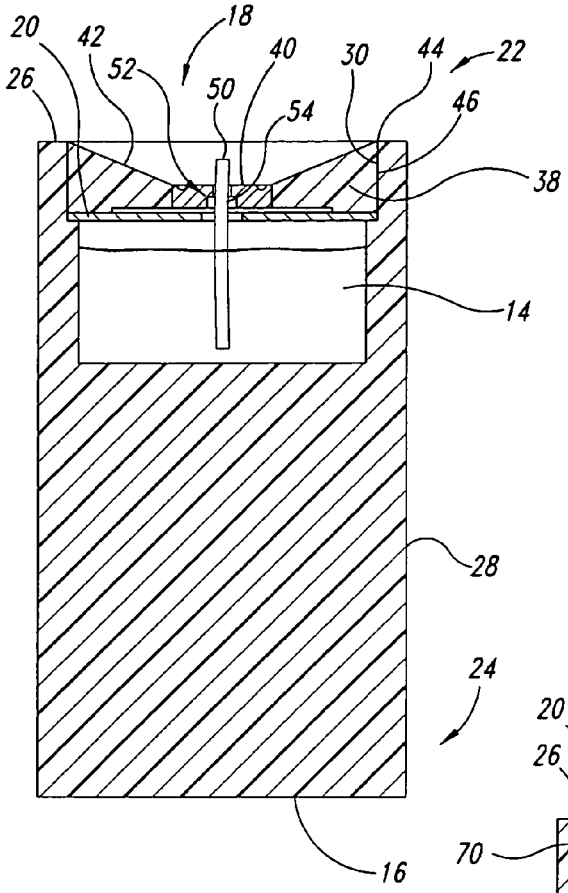
FIG. 7 is a cross-sectional view of a lamp according to yet another embodiment, wherein the receptacle receives the fuel directly, omitting the canister.

FIG. 7 shows still another embodiment of the lamp 10. The embodiment of FIG. 7 eliminates the canister 12, the fuel 14 being directly received in the receptacle 32. This embodiment includes the step or lip 66 of the embodiment previously described with reference to FIG. 5 for supporting the cover 18 in the absence of the canister 12. While reducing costs and allowing the use of any size receptacle, this embodiment may be more prone to spills.

Figure 8:
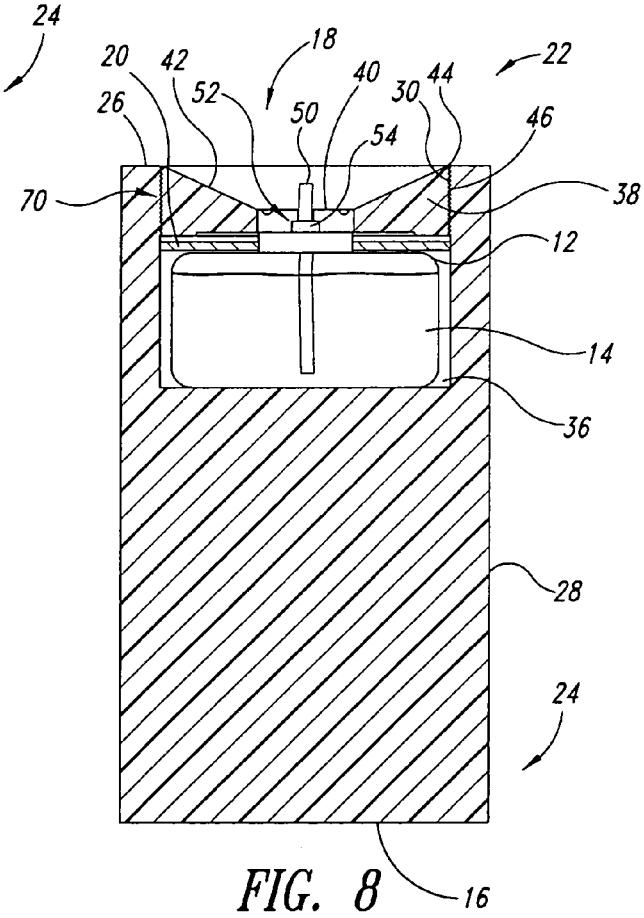
FIG. 8 is a cross-sectional view of a lamp according to yet even another embodiment, where the cover and a portion of the internal perimeter forming the receptacle each include threads to threadedly mate the cover to the body.

FIG. 8 shows still a further embodiment of the lamp 10. In the embodiment of FIG. 8, the inner perimeter 30 of the body 16 and the perimeter 46 of the outer member 38 of the cover 18 are each threaded 70 to threadedly engage one another for securing the cover 18 to the body 16. This embodiment provides a more secure containment of the canister 12, but may be more costly to manufacture and require more effort to refill or replace the canister 12 than previously discussed embodiments.

Figure 9:
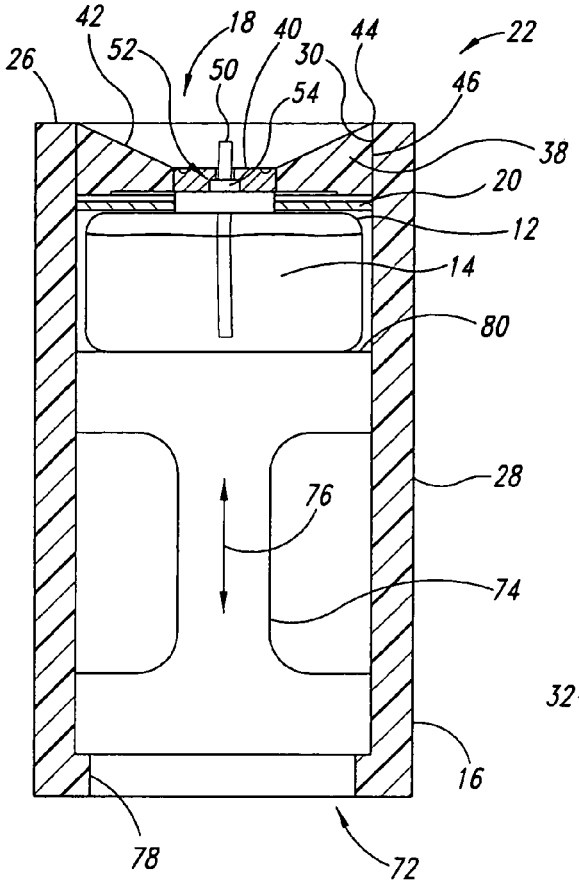
FIG. 9 is a cross-sectional view of a lamp according to a further embodiment, where the receptacle has an opening at both an upper end and a lower end of the body, the cover closes the opening at the upper end, and a slide mechanism closes the opening at the lower end of the body, and operable to exert a force on the cover to open the receptacle.

FIG. 9 shows yet a further embodiment of the lamp 10. In the embodiment illustrated in FIG. 9, the receptacle 32 formed by the body 16 has the first opening 34 formed at the upper end 22 and a second opening 72 formed at the lower end 24. A cover 18 similar to those previously discussed may be removable positionable with respect to the first opening 34. A slide mechanism 74 is slideably received in the receptacle 32 for longitudinal movement indicated by the double headed arrow 76. The slide mechanism 74 serves as a cover for the second opening 72. A stop 78 is formed in the receptacle 32 at the lower end 24 of the body 16 to retain the slide mechanism 74 within the receptacle 32. The canister 12 rests on an upper portion 80 of the slide mechanism 74 at an appropriate height with respect to the cover 18 such that the portion 54 of the lid 56 is received by the recess 52 in the inner member 40 and the wick 50 extends through the aperture 48. The slide mechanism 74 may be manually manipulated to push the canister 12 and the cover 18 upward, thus allowing the cover 18 to be easily removed without the use of special tools, to allow the replacement or replenishing of the canister 12 with fuel 14.

Figure 10:
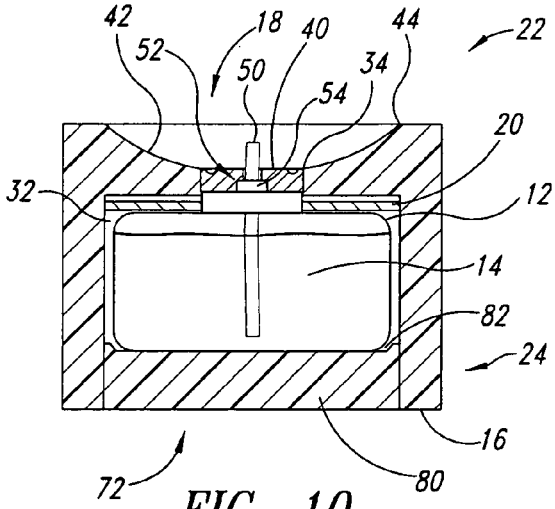
FIG. 10 is a cross-sectional view of a lamp according to a further embodiment, where the cover closes an opening in a lower end of the body.

FIG. 10 shows yet a further embodiment, where the receptacle 32 has the first opening 34 proximate the upper end 22 and the second opening 72 proximate the lower end 24 of the body 16. A first cover 18 similar to those discussed above is removably positionable with respect to the first opening 34, while a second cover 80 is removably positionable with respect to the second opening 72. The second cover 80 is not coupled or secured to the body 16, and includes a recess 82 which may contain any fuel 14 which may spill from the canister 12. Thus, the second cover 80 resembles a conventional coaster, but is sized to be received by the second opening 72.

Figure 11:
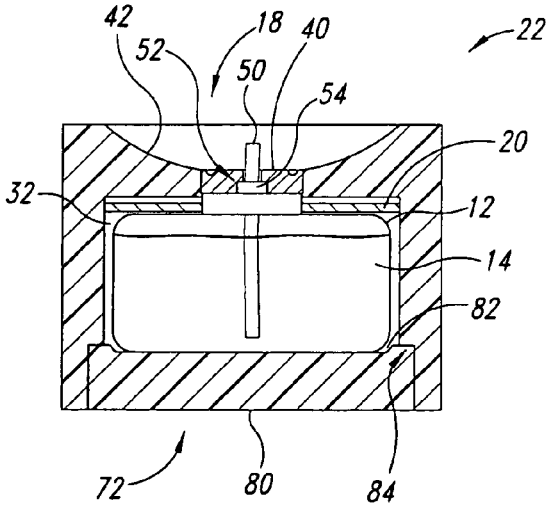
FIG. 11 is a cross-sectional view of a lamp according to still a further embodiment, where both an upper end and lower end of the body include openings that are closed by respective covers.

FIG. 11 shows still another embodiment of the lamp 10. The embodiment of FIG. 11 is similar to that of FIG. 10 however the receptacle 32 includes an instep 84 formed proximate the second opening 72 for engaging the second cover 80.

Figure 12:
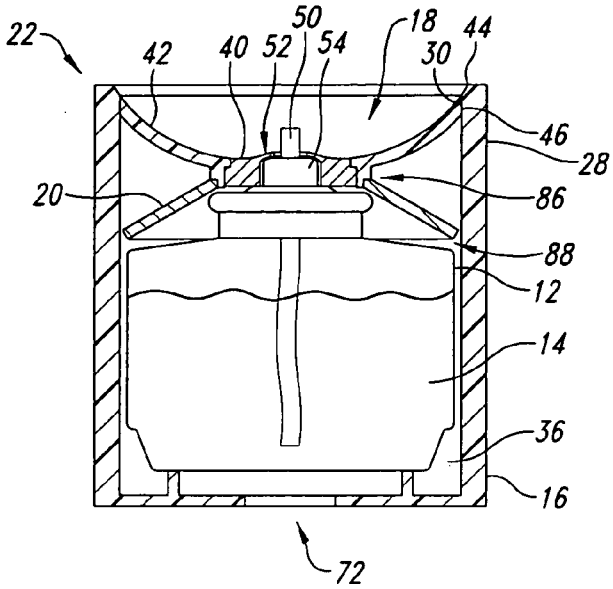
FIG. 12 is a cross-sectional view of a lamp according to still even another embodiment, where the outer member of the cover comprises a relatively thin perimeter and the opaque screen is frustro-conically shaped.

FIG. 12 shows yet even a further embodiment of the lamp 10 where the outer member 38 of the cover 18 comprises a relatively thin perimeter 46, that does not extend along the entire axial length of the outer member 38. The opaque screen 20 is frustro-conically shaped, and includes a small diameter 86 that is proximate the cover 18 and a large diameter 88 that is distal with respect to the cover 20. The frustro-conical shape may enhance the similarity of the visual effect produced by the lamp 10 with respect to common candles. The opaque screen 20 may be fastened or adhered to the outer member 38 to facilitate assembly during manufacturing and/or use.

Figure 13:
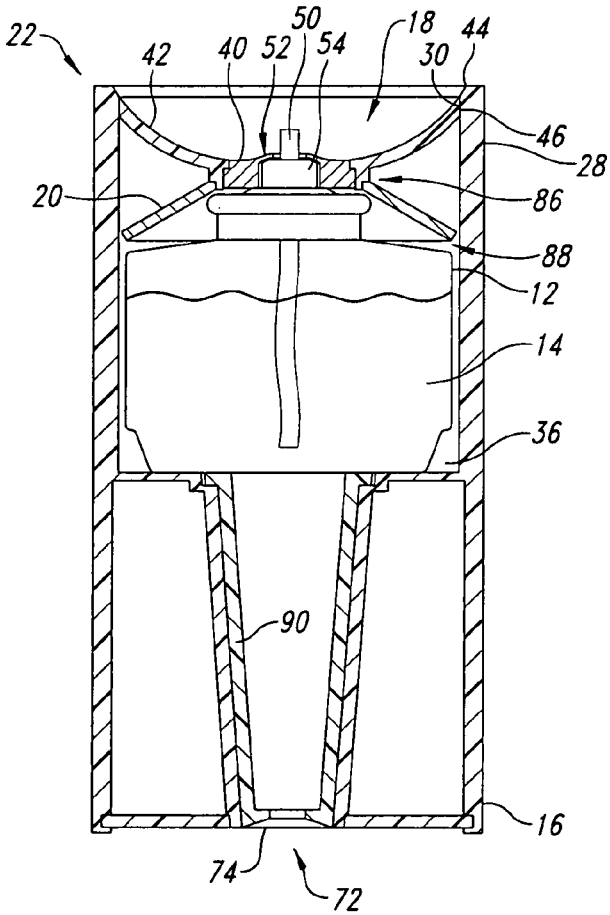
FIG. 13 is a cross-sectional view of a lamp according to still even another embodiment, similar in some respects to that of FIG. 12 and comprising a slide mechanism.

FIG. 13 shows an even further embodiment of the lamp 10, where the cover 18 and opaque screen 20 are similar in some respects to the embodiment of FIG. 12. However, in the embodiment of FIG. 13 the lamp 10 includes a slide mechanism 74 that operates in a similar fashion to the slide mechanism 74 of FIG. 9. In contrast to the embodiment of FIG. 9, the slide mechanism 74 of FIG. 13 is frustro-conically shaped, with a larger diameter proximate the canister 12 and a smaller diameter distal to the canister 12. The slide mechanism 74 is closely received by a frustro-conically shaped inner wall 90 formed in the receptacle 32 by the body 16. The slide mechanism 74 is accessible from an exterior of the body 16 to allow a user to easily remove the cover 18 by push the slide mechanism 74 upward, without significantly tilting the lamp 10 to prevent spills.

Figure 14:
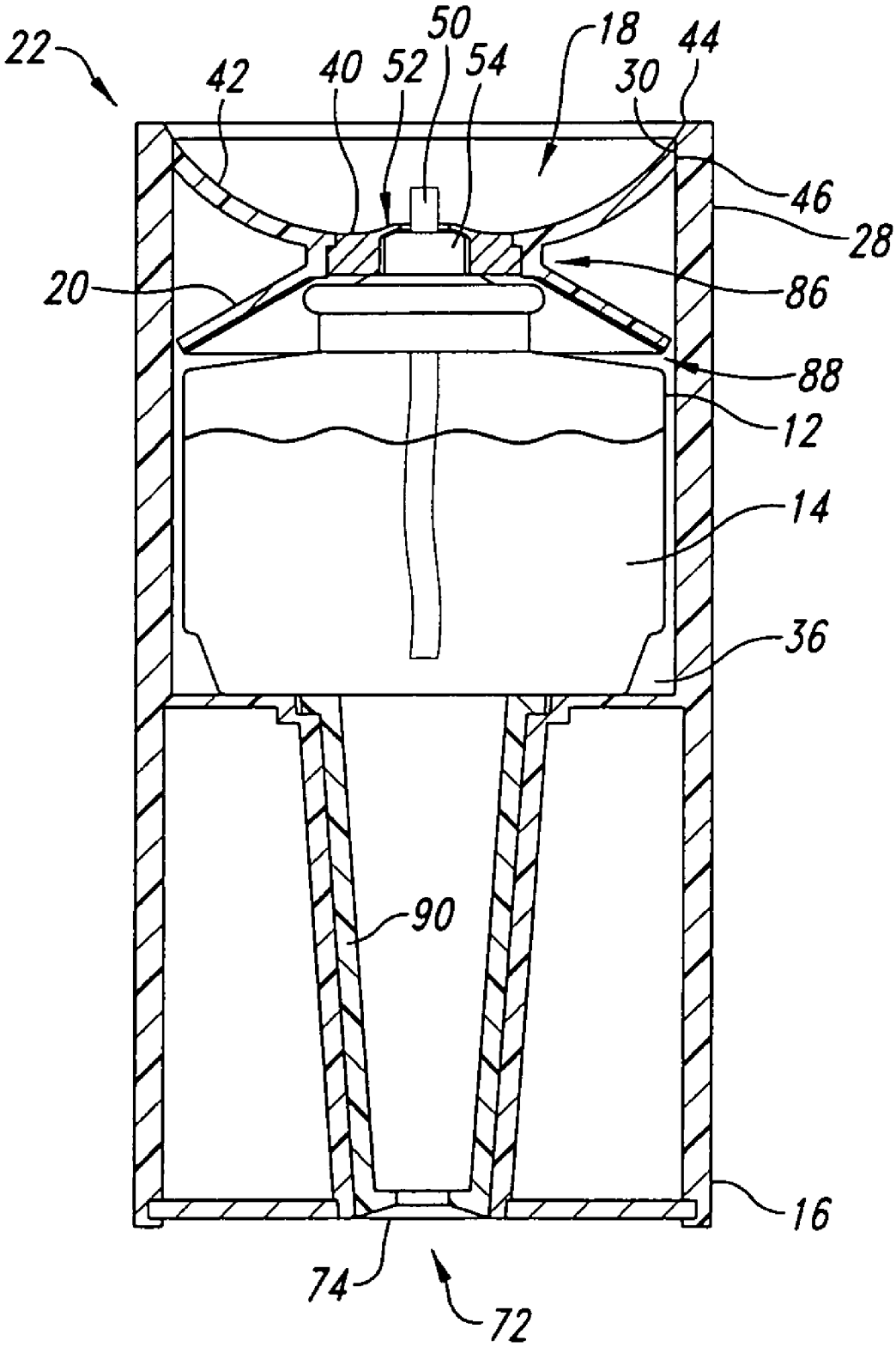
FIG. 14 is a cross-sectional view of a lamp according to still even another embodiment, similar in some respect to that of FIG. 13 but where the opaque screen and outer member of the cover are formed as a single integral unit.

FIG. 14 shows yet even another embodiment of the lamp 10 similar in some respect to that of FIG. 13. However, in the embodiment of FIG. 14 the outer member 38 of the cover 18 and opaque screen 20 are formed as a single integral piece, thereby reducing parts count and complexity of assembling the lamp 10.

Figure 15:
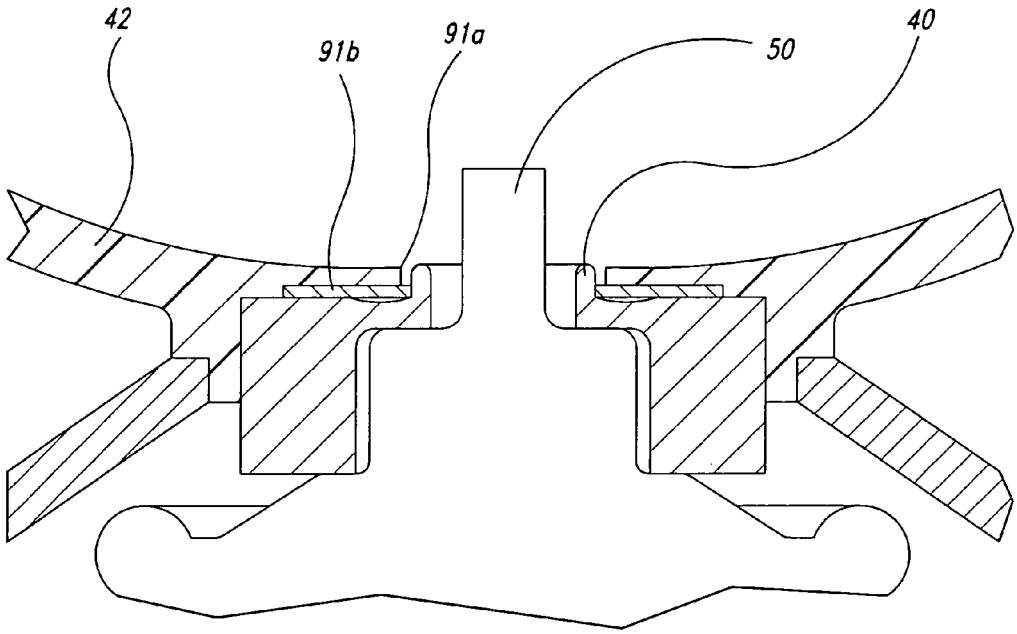
FIG. 15 is a partial cross-sectional view of a lamp according to still even another embodiment, similar in some respect to that of FIG. 14 but where the a space is formed between substantial portions of the inner and outer members.

FIG. 15 shows yet even another embodiment of the lamp 10 similar in some respect to that of FIG. 14. However, in the embodiment of FIG. 15 an inner portion of the inner member 40 is spaced from, and not in contact with, the outer member 38 of the cover 18, as illustrated at 91*a*, 91*b*. Only the outer portion of the inner member 40 contacts the outer member 38. This may allow substantial amounts of heat to dissipate from the inner member 40 before the heat can reach the outer member 38, advantageously reducing the heat transfer between the inner and outer members 40, 38, respectively. Reducing heat transfer alleviates potential problems that the outer member 38 may suffer, such as distortion and/or expansion, allowing the use of relatively low cost materials such as ABS plastic. Reducing heat transfer also advantageously permits use of a smaller diameter inner member 40, reducing material costs, and reducing the portion of the inner member 40 that is visible from the exterior of the lamp 10. The reduction in visible portion of the inner member 40 may eliminate the need to powder coat the inner member 40 to match the outer member 38 and body 16. The inner member 40 may be painted or otherwise colored black, to visually blend with the wick, adding to the illusion of a real candle.

Figure 16:
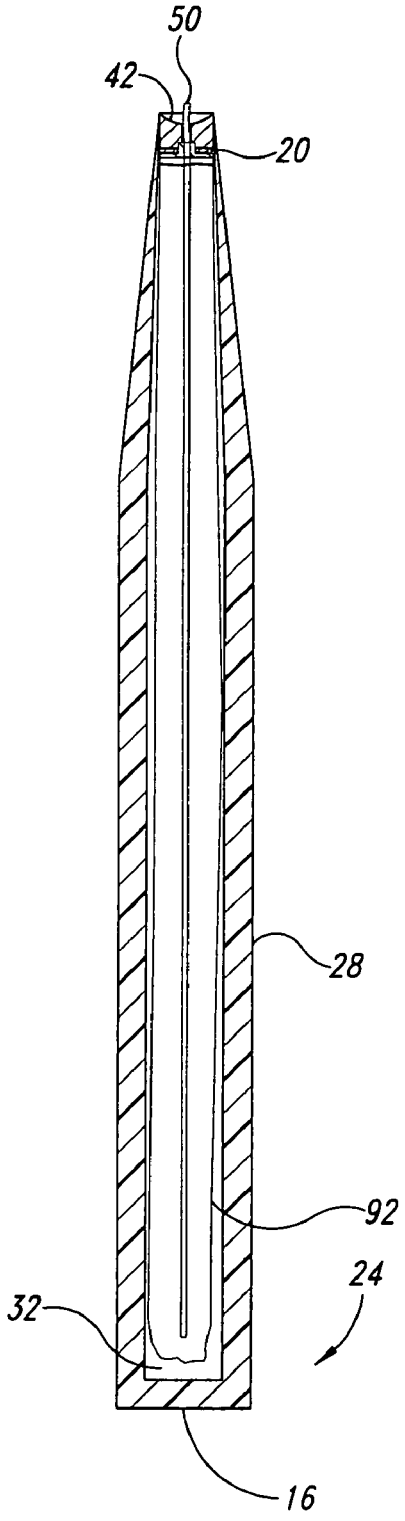
FIG. 16 is a cross-sectional view of a lamp according to still even another embodiment, where the body is of a frustro-conical or tapered shape and the canister is tubular and flexible.

FIG. 16 shows an even further embodiment of the lamp 10, where the body 16 is a frustro-conical form to resemble a tapered candle. The canister 12 may take the form of a generally tubular shape, and may have flexible sides 92 for being easily accommodated by the relatively long and narrow receptacle 32 formed by the wall 26 of the body 16. The flexible sided canister 12 thus resembles an elongated bag or pouch for receiving fuel 14. The bag or pouch is coupled to a lid 56, using a variety of possible techniques, for example via crimping. The lid 56 is preferably rigid, and may closely resemble the lids 56 generally discussed above.

Although specific embodiments of and examples for the lamp and method of manufacture and use are described herein for illustrative purposes, various equivalent modifications can be made without departing from the spirit and scope of the invention, as will be recognized by those skilled in the relevant art. The teachings provided herein of the invention can be applied to lamps, not necessarily the lamps generally described above.

The various embodiments described above can be combined to provide further embodiments. These and other changes can be made to the invention in light of the above-detailed description. In general, in the following claims, the terms used should not be construed to limit the invention to the specific embodiments disclosed in the specification and the claims, but should be construed to include all lamps that comprise the structures of the claims. Accordingly, the invention is not limited by the disclosure, but instead its scope is to be determined entirely by the following claims.

All of the above U.S. patents, U.S. patent application publications, U.S. patent applications, foreign patents, foreign patent applications and non-patent publications referred to in this specification and/or listed in the Application Data Sheet, including but not limited to U.S. Design patent application Ser. No. 29/197,093, entitled "OIL LAMP," and filed Jan. 8, 2004, and U.S. Design patent application Ser. No. 29/197,094, entitled "OIL LAMP," and filed Jan. 8, 2004, are incorporated herein by reference, in their entirety.

The invention claimed is:

1. An oil lamp, comprising:

a body having an upper end and a lower end opposed to the upper end, the body comprising a wall having an outer perimeter and an inner perimeter, the inner perimeter of the wall forming at least a portion of a receptacle, the receptacle open about at least one of the upper and the lower ends of the body; and a cover removably positionable with respect to the open one of the upper and the lower ends of the body to substantially close the receptacle when in use; and a non-flammable inner member positioned in one of the cover and the body, the inner member forming an aperture therethrough for providing access to an exterior of the receptacle, the aperture sized to receive a portion of a wick therethrough, wherein the one of the body and the cover in which the inner member is positioned has a concave face concentric about the inner member and is translucent at least proximate the concave face, and wherein the aperture is spaced below an outer edge of the concave face.

2. The oil lamp of claim 1 wherein the inner member is concentrically mounted in the cover, the upper end of the body is open, and the cover closes the upper end when the oil lamp is in use.

3. The oil lamp of claim 1 wherein the inner member is concentrically mounted in the body proximate the upper end, the lower end of the body is open, and the cover closes the lower end when the oil lamp is in use.

4. The oil lamp of claim 1 wherein the inner member is secured concentrically in the cover.

5. The oil lamp of claim 1, further comprising:

an opaque screen having an outer perimeter sized for being closely received in the receptacle, the opaque screen having a hole sized to at least receive a portion of the wick therethrough.

6. The oil lamp of claim 1 wherein the outer edge of the concave face is approximately coextensive with an outer perimeter of the cover.

7. The oil lamp of claim 1, further comprising:

a slide mechanism slidably received in the receptacle and operable to exert a force on the cover.

8. An oil lamp, comprising:

a body having an upper end and a lower end opposed to the upper end, the body comprising a wall having an outer perimeter and an inner perimeter, the inner perimeter of the wall forming at least a portion of a receptacle, the receptacle having an opening proximate at least the upper end of the body; and a cover removably positionable with respect to the upper end of the body to substantially close the opening of receptacle, the cover comprising an outer member and an inner member, the outer member having a concave face with an outer edge, at least a portion of the outer member proximate the concave face being translucent, and, the inner member having an aperture formed therethrough for providing access to an exterior of the receptacle, the aperture sized to receive a portion of a wick therethrough, wherein an exit for the wick formed by the aperture is spaced relatively beneath the outer edge of the concave face such that a topmost portion of the wick is positioned below the upper end when in use.

9. The oil lamp of claim 8, further comprising:

an opaque screen having an outer perimeter sized for being closely received in the receptacle beneath the cover, the opaque screen having a hole sized to at least receive a portion of the wick therethrough.

10. The oil lamp of claim 8, further comprising:

an opaque screen having an outer perimeter sized for being closely received in the receptacle beneath the cover, the opaque screen having a hole sized to at least receive a portion of the wick therethrough, the opaque screen having a reflective surface facing the cover.

11. The oil lamp of claim 10, further comprising:

wherein the opaque screen is frustro-conically shaped, the opaque screen having a smaller diameter portion proximate the cover and a large diameter portion distal to the cover.

12. The oil lamp of claim 8 wherein the outer edge of the concave face is approximately coextensive with an outer perimeter of the cover.

13. The oil lamp of claim 8 wherein an outer edge of the concave face is approximately coextensive with an outer perimeter of the cover, and the outer perimeter of the cover is closely received by the inner perimeter of the wall forming the receptacle.

14. The oil lamp of claim 8 wherein the wall of the body is translucent proximate at least the upper end of the body.

15. The oil lamp of claim 8 wherein the outer member and the inner member are dissimilar materials.

16. The oil lamp of claim 8 wherein the inner member of the cover is non-flammable.

17. The oil lamp of claim 8 wherein the inner member of the cover is a high density steel.

18. The oil lamp of claim 8 wherein the outer member of the cover is composed of a material selected from the group consisting of thermal setting resin, acetal resin, and glass filed nylon resin.

19. The oil lamp of claim 8 wherein body and outer member of cover consist of different materials.

20. The oil lamp of claim 8 wherein the inner member of the cover has a channel formed therein proximate the aperture to receive a scent oil.

21. The oil lamp of claim 8 wherein the inner member of the cover has a circular channel formed therein concentric with, and proximate, the aperture to receive a scent oil.

22. The oil lamp of claim 8, further comprising:

a canister of oil having an outer perimeter and height sized and dimension to be removable received in the receptacle of the body.

23. The oil lamp of claim 8 wherein the body is substantially cylindrical.

24. The oil lamp of claim 8 wherein the body is substantially frustro-conical.

25. The oil lamp of claim 8 wherein the concave face has a non-linear slope.

26. The oil lamp of claim 8 wherein the concave face has a linear slope.

27. The oil lamp of claim 8, further comprising:

a slide mechanism slidably received in the receptacle and operable to exert a force on the cover.

28. An oil lamp, comprising:

a body having an upper end and a lower end opposed to the upper end, the body comprising a wall having an outer perimeter and an inner perimeter, the inner perimeter of the wall forming at least a portion of a receptacle, the receptacle open proximate at least one of the upper and the lower ends of the body;

a cover having a concave face, the cover removably positionable with respect to the upper end to substantially close the receptacle, the cover comprising an outer portion and an inner portion of dissimilar materials, the inner portion having an aperture formed therethrough for providing access to an exterior of the receptacle, the aperture sized to receive a portion of a wick therethrough, wherein the outer portion of the cover is translucent and wherein an outer edge of the concave face is approximately coextensive with an outer perimeter of the cover, and the outer perimeter of the cover is closely received by the inner perimeter of the wall forming the receptacle; and an opaque screen having an outer perimeter sized for being closely received in the receptacle beneath the cover, the opaque screen having a hole sized to at least receive a portion of the wick therethrough, the opaque screen having a reflective surface facing the cover.

29. The oil lamp of claim 28 wherein the inner member of the cover is a high density steel and the outer member of the cover is composed of a material selected from the group consisting of thermal setting resin, acetal resin, and glass filed nylon resin.

* * * * *